US005501136A

United States Patent [19]

Wennerbo et al.

[11] Patent Number: 5,501,136

[45] Date of Patent: Mar. 26, 1996

[54] CONTROL SYSTEM FOR A HYDRAULIC MOTOR

[75] Inventors: Orjan E. V. Wennerbo, Boras, Sweden; Kyle G. Martyn, Huddensfield, Great Britain

[73] Assignee: Voac Hydraulics Boras AB, Boras, Sweden

[21] Appl. No.: 265,244

[22] Filed: Jun. 24, 1994

[30] Foreign Application Priority Data

Jun. 24, 1993 [SE] Sweden ..... 9302207

[51] Int. Cl.[6] ..... F15B 11/08; F15B 13/04

[52] U.S. Cl. ..... 91/446; 91/468; 91/448; 137/596; 137/596.13

[58] Field of Search ..... 91/446, 448, 468; 137/596, 596.13

[56] References Cited

U.S. PATENT DOCUMENTS

| | | | |
|---|---|---|---|
| 1,964,196 | 6/1934 | Cuttat | 91/448 X |
| 3,455,210 | 7/1969 | Allen | 91/446 |
| 3,777,773 | 12/1973 | Tolbert | 91/446 X |
| 4,180,098 | 12/1979 | Budzich | 91/446 X |
| 4,282,898 | 8/1981 | Harmon et al. | 137/596.13 |
| 4,555,977 | 12/1985 | Motzer | 91/446 |
| 4,779,419 | 10/1988 | Crosser et al. | 91/446 X |
| 4,967,557 | 11/1990 | Izumi et al. | 91/446 X |
| 5,152,140 | 10/1992 | Hirata et al. | 91/446 X |
| 5,222,426 | 6/1993 | Marcon et al. | 91/446 |
| 5,409,038 | 4/1995 | Yoshida et al. | 91/446 X |

FOREIGN PATENT DOCUMENTS

| | | | |
|---|---|---|---|
| 0377544 | 7/1990 | European Pat. Off. . | |
| 3709504 | 10/1988 | Germany . | |
| 4230183 | 3/1993 | Germany . | |
| 193907 | 11/1983 | Japan | 97/446 |

*Primary Examiner*—John Ryznic

*Attorney, Agent, or Firm*—Frishauf, Holtz, Goodman, Langer & Chick

[57] ABSTRACT

A control means for a hydraulic motor connected to an external load comprises a directional valve (10) for selectively feeding hydraulic fluid to the motor from a pressure source and including load pressure sensing means (24, 25) connected to a load compensating valve (15) located upstream of the directional valve (10) for adjusting automatically the feed pressure in relation to the actual load pressure. The load compensating valve (15) includes a valve spindle (28) with opposite end surfaces (29, 30), one of which is exposed to the load pressure whereas the other is exposed to the feed pressure, and a selectively activatable feed pressure reducing means (38, 43; 50–57) for increasing the bias force acting on the load compensating valve spindle (28) in the closing direction of the latter in relation to the bias force acting in the closing direction of said valve spindle (28).

3 Claims, 2 Drawing Sheets

CONTROL SYSTEM FOR A HYDRAULIC MOTOR

BACKGROUND OF THE INVENTION

This invention relates to a control means for a hydraulic motor connected to an external load and which comprises a directional valve for selectively feeding hydraulic fluid to the motor from a pressure source.

The directional valve is provided with load pressure sensing means which is connected to a load compensating valve located upstream of the directional valve and arranged to adjust automatically the feed pressure in relation to the load pressure, which load compensating valve includes a valve spindle having oppositely facing end surfaces one of which is exposed to the load pressure for biassing the valve spindle in the opening direction, whereas the other end surface is exposed to the feed pressure for biassing the valve spindle in the closing direction.

OBJECT OF THE INVENTION

The object of the invention is to accomplish an improved control means of the above type by which there is possible to obtain a certain degree of feed pressure reduction and accordingly a motor speed reduction in case very heavy loads are to be handled by the motor, loads that are heavier than what is allowed as maximum load for a particular motor application. This is to avoid hazardous inertia forces when moving a heavy object by means of the motor.

Preferred embodiments of the invention are described below with reference to the accompanying drawings.

DETAILED DESCRIPTION

Figure 1:
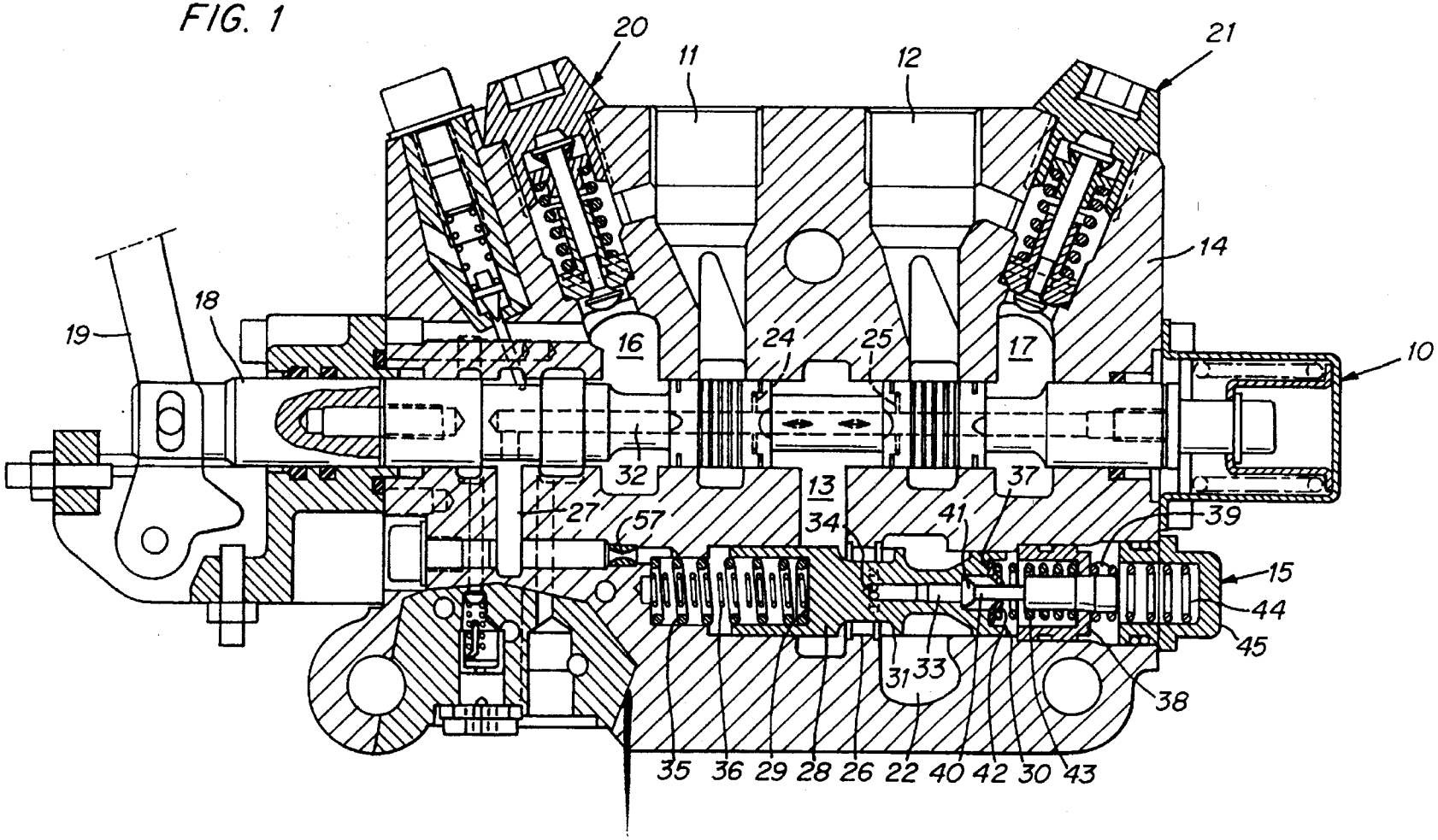
FIG. 1 shows a longitudinal section through a valve unit provided with a feed pressure reducing means according to the invention.

The control valve unit shown in FIG. 1 comprises a housing 14 with a directional valve 10 having service ports 11, 12 connected to a hydraulic motor (not shown). The directional valve 10 also includes an inlet port 13 connected to a pressure fluid source via a load compensating valve 15 and a supply passage 22, two discharge ports 16, 17 connected to a tank, and a valve spindle 18. The latter is shiftable by an external manoeuver means as a lever 19 to direct hydraulic fluid to and from the motor and tank by controlling the ports 11, 12, 13, 16, and 17.

The service ports 11, 12 are connectable to the discharge ports 16, 17 by means of pressure controlled shunt valves 20, 21.

In the housing 14, upstream of the directional valve 10, there is located the load compensating valve 15 which is arranged to adjust the feed pressure in the inlet port 13 in relation to the actual load on the motor. To this end, the spindle 18 of the directional valve 10 is provided with load pressure sensing passages 24, 25 which are connected to a longitudinal passage 32 in the valve spindle 18 and arranged to be alternatively brought into communication with the service ports 11, 12 as the valve spindle 18 is shifted in either direction to direct pressure fluid out through one of the service ports 11, 12.

A passage 27 in the valve housing 14 leads the load pressure from the spindle 18 to the left end of the load compensating valve 15. The latter comprises a valve spindle 28 which has two oppositely facing end surfaces 29, 30 and a central shoulder 31 for controlling the fluid flow past a land 26 in the housing 14 and, accordingly, the feed pressure in the inlet port 13. The right end surface 30 of the compensating valve spindle 28 is pressurized by the feed pressure in the inlet port 13 in that the right end surface 30 communicates with the latter via a central passage 33 and radial openings 34 in the valve spindle 28.

At its left end, the compensating valve spindle 28 is acted upon by two springs 35, 36 which together with the load pressure communicated through the passage 27 balance the valve spindle 28 against the feed pressure communicated to the right end surfaces 30 through the passage 33 and openings 34. Depending on the actual load pressure, the fluid passage between the shoulder 31 of the valve spindle 28 and the land 26 in the housing 14 restricts the supply flow to a desired degree determined by the characteristics of the springs 35, 36.

Figure 2:
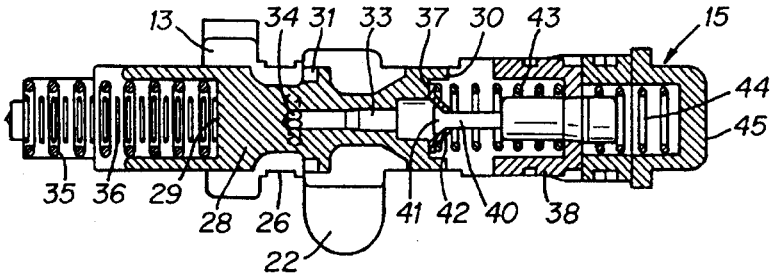
FIG. 2 shows, on a larger scale, the load compensating valve in FIG. 1, and illustrates the feed pressure reducing means in its inactive position.

At the right hand end of the valve spindle 28, there is movably guided a cup-shaped piston 38 which on its left hand end is acted upon by the fluid pressure in the inlet port 13 supplied via the passage 33 and openings 34 in the valve spindle 28,and which is shiftable by pressure fluid selectively supplied from a pressure fluid supply source (not shown) to its opposite end through an opening 39. The piston 38 is shiftable between an inactive position as shown in FIG. 2 and an active position as shown in FIG. 1. The piston 38 carries a coaxially extending support rod 40 which at its outer end is formed with a head 41. On the support rod 40 there is movably guided a spring supporting washer 42, and a spring 43 which acts between the piston 38 and the washer 42. The washer 42 is arranged to cooperate with a shoulder 37 on the valve spindle 28. An auxiliary spring 44 is inserted between the piston 38 and an end cap 45 on the housing 14 to exert a bias force on the piston 38.

In operation, pressure fluid is supplied through the passage 22, passing the shoulder 31 of the compensating valve spindle 28, reaching the directional valve 10 via the inlet port 13 and is directed to the motor through one of the service ports 11, 12. The actual load pressure is communicated from the load pressure sensing passages 24, 25, via the passage 27 to the left end surface 29 of the valve spindle 28 so as to exert a bias force on the latter.

Depending on the actual load pressure acting on the valve spindle 28, the fluid flow past the shoulder 31 is restricted such that the feed pressure which prevails downstream the shoulder 31 and which is communicated to the right end surface 30 of the valve spindle 28 will balance the joint bias force of the load pressure and the springs 35, 36 acting on the valve spindle 28 in the opposite direction.

When it is desired to activate the motor under very heavy load circumstances the motor speed must be kept down to avoid hazardous inertia forces. This is accomplished by directing pressure fluid from a pressure fluid supply source (not shown) onto the piston 38 via the opening 39, thereby making the piston 38 move to the left such that the washer 42 lands on the shoulder 37 on the valve spindle 28. In this position of the piston 38, the washer 42 is lifted off the head 41 of the support rod 40, which means that the spring 43 now is free to act between the piston 38 and the valve spindle 28.

Accordingly, an auxiliary bias force is applied on the latter in the closing direction of the shoulder 31 relative to the land 26, which means that the feed pressure in the inlet port 13 is further decreased, as is the motor speed.

At deactivation of the feed pressure or speed reducing means, the fluid pressure supplied through the opening 39 is discharged and the piston 38 is moved to the right by the feed pressure prevailing in the chamber between the valve spindle 28 and the piston 38. During that movement of the piston 38, the head 41 of the support rod 40 engages the washer 42 and lifts the latter off the shoulder 37 on the valve spindle 28, thereby removing the auxiliary bias force exerted by the spring 44 from the valve spindle 28. Then, the load compensating valve 15 will resume its normal operation order.

Figure 3:
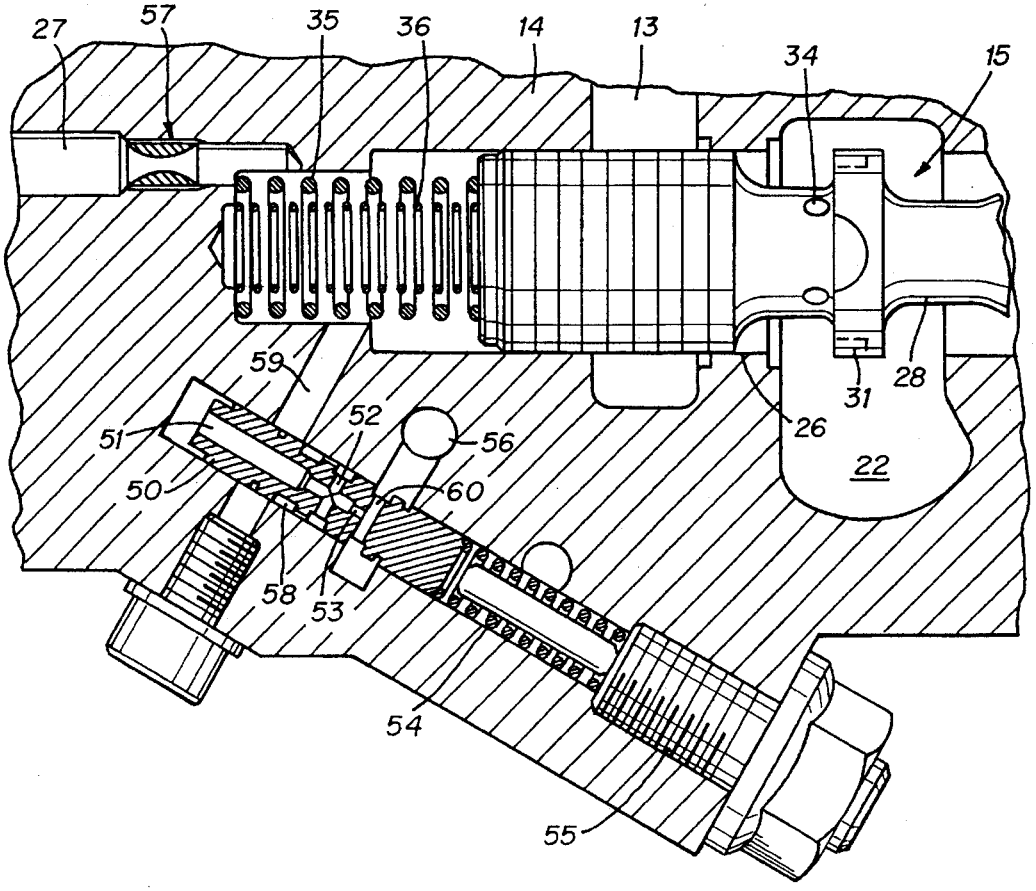
FIG. 3 shows an alternative embodiment of the invention.

In FIG. 3, there is shown an alternative embodiment of the invention in which the balance of bias forces acting on the load compensating valve spindle 28 is altered by reducing the bias force accomplished by the load pressure on the left end surface 29 of the valve spindle 28 instead of adding an auxiliary spring force on the opposite valve spindle end, as described above. This is accomplished by draining to tank a constant fluid flow from the left load pressure exposed end of the valve spindle 28. The result will be the same, however, namely that the valve spindle 28 occupies a balanced position further to the left as if the load pressure were lower than it really is.

To accomplish this bias pressure reduction, there is employed a pressure reduction valve which communicates with the left hand end of the valve spindle 28 via a passage 59. The pressure reduction valve comprises a valve element 50 having an internal passage 51 with radial openings 52 and a restriction opening 53. The radial openings 52 communicate with an external peripheral groove 58 on the valve element 50. Normally, the valve element 50 is balanced between a spring 54 supported by a setting screw 55 and the fluid pressure supplied to the left end of the valve element 50 via the groove 58, the openings 52 and the passage 51. The flow restriction opening 53 communicates with a drain passage 56 via a diametrical bore 60 in the valve element 50. The drain passage 56 comprises an activatable pressure discharge valve (not shown). The load pressure passage 27 is provided with a flow restriction 57.

In operation, the drain passage 56 is connected to tank via the non-illustrated discharge valve, whereby fluid starts flowing to the pressure reduction valve element 50 from the load pressure chamber at the left end of the valve spindle 28 via the passage 59. A self adjustment of the valve element 50 is obtained, and depending on the setting of the screw 55 and the bias load of the spring 54 the pressure in the passage 51 assumes a certain constant level. This results in a constant flow through the restriction opening 53 as well as a certain pressure drop across the restriction 57. Accordingly, a reduced pressure load acting on the left end surface 29 of the valve spindle 28 is obtained. In consequence, the load compensating valve 15 will deliver fluid of a further reduced pressure to the inlet port 13 of the directional valve 10.

We claim:

1. A control system for a hydraulic motor connected to an external load, the control system comprising:

a directional valve (10) having load pressure sensing means (24, 25) for sensing a load pressure, and said directional valve (10) being arranged to selectively feed hydraulic fluid to said motor from a pressure source; and a load compensating valve (15) located upstream of said directional valve (10) and connected to said load pressure sensing means (24, 25) and arranged to adjust a feed pressure of hydraulic fluid in relation to an actual load pressure;

said load compensating valve (15) including:

a valve spindle (28) having oppositely facing end surfaces (29,30), one (29) of said oppositely facing end surfaces being exposed to the actual load pressure for biassing said valve spindle (28) in an opening direction, and another of said oppositely facing end surfaces (30) being exposed to the hydraulic fluid feed pressure for biassing said valve spindle (28) in a closing direction;

a selectively activatable feed pressure reducing means comprising a spring element (43) applicable on said valve spindle (28) in the closing direction of the valve spindle; and an actuating piston (38) selectively shiftable by fluid pressure from an inactive position in which said actuating piston (38) inhibits action of said spring element (43) to an active position in which said actuating piston (38) applies said spring element (43) onto said valve spindle (28) to thereby accomplish an increased bias force acting on said valve spindle (28) in the closing direction of said valve spindle (28).

2. A control system according to claim 1, wherein said actuating piston (38) has one end which is exposed to said hydraulic fluid feed pressure for being biassed toward said inactive position, and an opposite end which is selectively pressurized for being actuated toward said active position.

3. A control system for a hydraulic motor connected to an external load, the control system comprising:

a directional valve (10) having load pressure sensing means (24, 25) for sensing a load pressure, and said directional valve (10) being arranged to selectively feed hydraulic fluid to said motor from a pressure source; and a load compensating valve (15) located upstream of said directional valve (10) and connected to said load pressure sensing means (24, 25) and arranged to adjust a feed pressure of hydraulic fluid in relation to an actual load pressure;

said load compensating valve (15) including:

a valve spindle (28) having oppositely facing end surfaces (29,30), one (29) of said oppositely facing end surfaces being exposed to the actual load pressure for biassing said valve spindle (28) in an opening direction, and another of said oppositely facing end surfaces (30) being exposed to the hydraulic fluid feed pressure for biassing said valve spindle (28) in a closing direction;

a selectively activatable feed pressure reducing means comprising a drain passage (56) selectively connectable to a tank; and a constant flow valve means (50–53) located between said drain passage (56) and said one load pressure exposed end surface (29) of said valve spindle (28) and arranged to provide a pressure reduction on said one load pressure exposed end (29) of said valve spindle (28) and in consequence a further reduction of the feed pressure downstream of said load compensating valve (15).

* * * * *